United States Patent [19]

Kjesbo

[11] 4,219,206

[45] Aug. 26, 1980

[54] ANTI-TIP CROSSING DEVICE FOR SKIS

[75] Inventor: Craig R. Kjesbo, Ketchum, Id.

[73] Assignee: Performance Counts, Inc., Ketchum, Id.

[21] Appl. No.: 869,666

[22] Filed: Jan. 16, 1978

[51] Int. Cl.[2] ..... A63C 11/00

[52] U.S. Cl. ..... 280/817; 280/601

[58] Field of Search ..... 280/11.37 E, 601

[56] References Cited

U.S. PATENT DOCUMENTS

| | | | |
|---|---|---|---|
| 3,148,891 | 9/1964 | Heuvel | 280/11.37 E |
| 3,295,860 | 1/1967 | Von Hoven | 280/11.37 E |
| 3,910,593 | 10/1975 | Schwarz | 280/11.37 E |

FOREIGN PATENT DOCUMENTS

| | | | |
|---|---|---|---|
| 2441590 | 3/1975 | Fed. Rep. of Germany | 280/11.37 E |
| 2632659 | 2/1977 | Fed. Rep. of Germany | 280/11.37 E |
| 2549693 | 5/1977 | Fed. Rep. of Germany | 280/11.37 E |
| 2612457 | 10/1977 | Fed. Rep. of Germany | 280/11.37 E |
| 2307558 | 11/1976 | France | 280/11.37 E |
| 622961 | 6/1961 | Italy | 280/11.37 E |

*Primary Examiner*—David M. Mitchell

*Attorney, Agent, or Firm*—Earl L. Tyner

[57] ABSTRACT

An anti-tip crossing device for skis adapted to be mounted on the front upper surface of a ski comprising a hollow triangular shaped object having a curved surface adjacent to the outer edge of the ski and a substantially perpendicular surface adjacent the inner edge of the ski, the entire object being detachably mounted for easy removal when desired; this device serving the purpose of preventing crossing of the tips of the skis in normal use and being shaped to permit skis when they are crossed to be redirected in their parallel alignment with the least resistance to that movement by the skier.

10 Claims, 3 Drawing Figures

ANTI-TIP CROSSING DEVICE FOR SKIS

This invention relates to a device for preventing skis from crossing their tips during use and for easy recovery from tip crossing if such should happen.

There are known several devices which serve the purpose of preventing the skis from crossing during use. Some of these devices are made in a solid trapezoidal form of a hard non-resilient plastic material, these devices being attached by any suitable means to the forward portion of each ski. Other devices are attached in a fashion such that the device has a mechanical hinge permitting the device to fold towards the center of the two skis when the crossed skis are returned to their parallel position, and this hinged device is spring-loaded to cause the device to return to its upright position as the skis are returned to their parallel alignment. These prior art devices serve their intended purpose but they are heavier in weight than is desired, they frequently break in use because the materials from which they are made are somewhat brittle and hard, and in the case of the hinged device, the crossed skis must be separated too a greater degree than necessary in order to permit the hinged portion to return to its upright position and this is not desirable in many instances. The device of my present invention provides improvements in many of these features. My device is considerably lighter in weight, simpler in structure, and permits a proper guiding surface for uncrossing skis with the least effort. Furthermore, my device is made of a material which is resilient and able to withstand the many shocks imparted to it during use and at the same time, to prevent damage to the sharpened edges of the skis during contact with my device.

It is an object of this invention to provide an improved device to be attached to the forward portion of skis to prevent the tips from crossing during use. It is another object of this invention to provide a device which will facilitate the recovery of crossed skis to their proper parallel alignment. It is still another object of this invention to provide such a device with a minimum number of parts which can be easily attached or detached from the ski in accordance with the desires of the user. It is still another object of this invention to provide such a device made of a wear-resistant material and designed with a pleasing aesthetic appearance. It is still another object of this invention to provide such a device being as streamlined as possible so as to provide the least resistance to air flow through and around it. Still other objects of this invention will appear in a more detailed description which follows.

This invention comprises an anti-tip crossing device for skis adapted to be mounted on the front, upper surface of a ski, comprising a hollow, generally triangular shaped resilient plastic member with its base substantially the width of said ski, the upwardly directed portion adjacent the inside edge of the ski being substantially perpendicular to the said upper surface, and the upwardly directed portion adjacent the outside edge of the ski being convexly arcuate in shape.

In particularly preferred embodiments of this invention, the device is mounted in such a fashion that it is easily detachable from the skis when the skier does not require its use. In another preferred embodiment, the base portion of the triangular member is split in an axial direction parallel to the edges of the ski and with each portion formed with a flange that is adapted to cooperate with a fastening member fixed to the ski so that the triangular portion can be snapped into place or out of place as the member is attached or detached from the plate without the use of tools. It still another preferred embodiment, the fastening member is attached adhesively to the upper surface of the ski by means of a vibration dampening resilient interlayer.

FIG. 4 is another embodiment of the device shown in FIG. 3.

Figure 1:
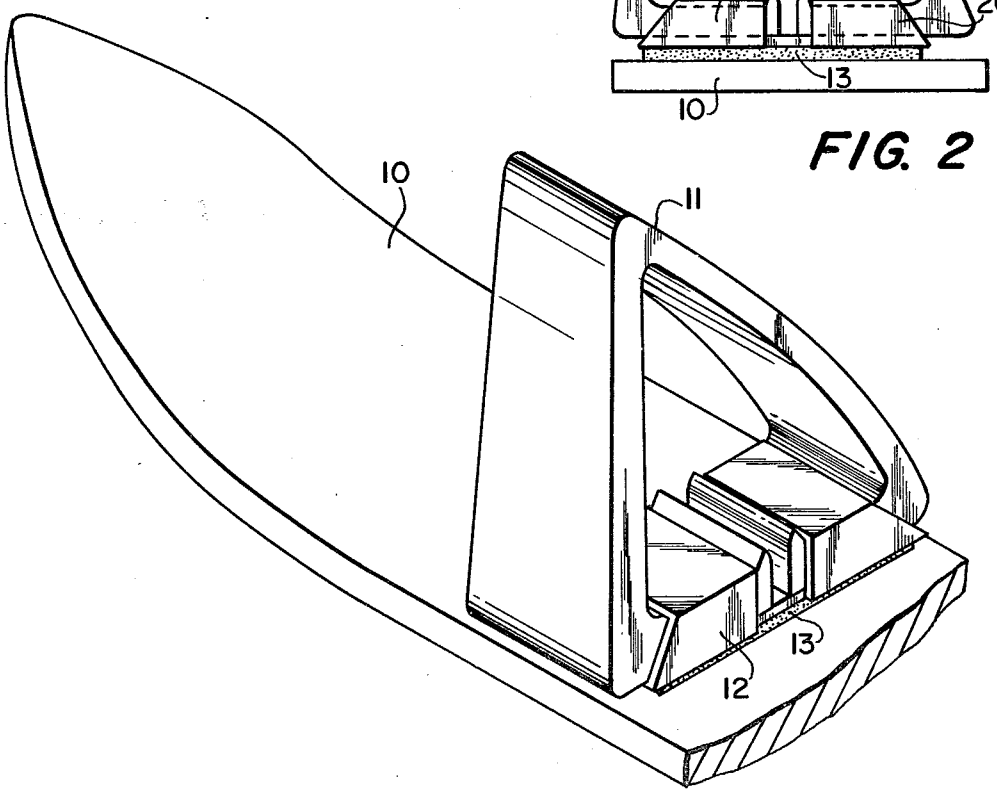
FIG. 1 is a drawing in perspective of the device of this invention mounted on the forward portion of a ski.

In FIG. 1 there is shown the forward portion of a ski (10) having mounted thereon the anti-tip crossing device (11) held in place by a fastening plate (12) by means of an adhesive interlayer (13). It will be appreciated that this sketch is of the right-hand ski and that the lefthand ski would have a similar device mounted in a mirror image of the one shown. The exact configuration of the anti-tip crossing device (11) is identical in both instances and merely must be oriented in the proper direction for use on the left-hand ski as will be readily understood by those familiar with such devices.

Figure 3:
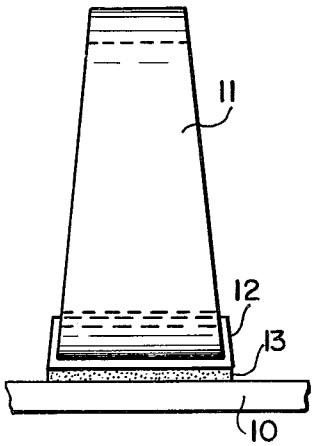
FIG. 3 is a side view of the device shown in FIG. 2.
Figure 2:
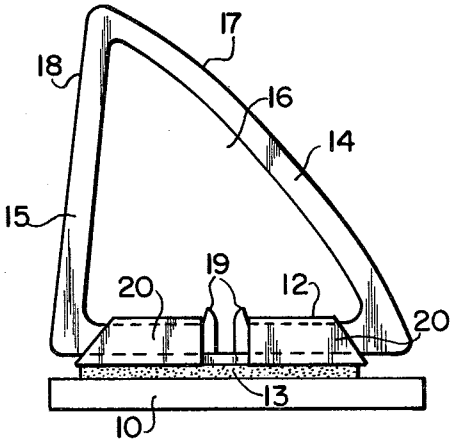
FIG. 2 is a view in elevation of the device of this invention positioned on a ski.

The more detailed configuration of the device of this invention is seen by reference to FIGS. 2 and 3 wherein ski (10) is shown with the device mounted on its upper surface. The device of this invention has a generally triangular shape with the portion adjacent the inside edge (15) being generally perpendicular with respect to the ski and the portion adjacent the outside edge (14) being generally curved in a convex configuration from the outside edge of the ski to the top of the device. The base of the triangular device is made substantially flat and in the width conforming to the width of ski (10) in the particular embodiment shown in FIG. 2, the base portion is split into two portions (20) each of which terminates in a flange (19) adapted to fit into the hollow interior portion of fastening member (12). The triangular device is made of a resilient plastic material such that the flanges (19) are able to slide through the hollow portions of fastening plate (12) for attachment or for detachment of the device from the ski. Fastening plate (12) is fixed to the upper surface of ski (10) by means of an adhesive interlayer (13) employing any suitable adhesive for this purpose, such as a resilient epoxy cement, a contact cement, or the like. Interlayer (13) is preferably made of a resilient material which serves the further purpose of being a vibration dampener to reduce the affect of any shock applied to the triangular device or any bending or flexing occurring in the ski during use. This interlayer thereby provides the capability of maintaining the device in its intended location through all of the impacts and rigors of use which are encountered.

The general shape of the two upwardly extending surfaces (17) and (18) of this device are important in that both should be at least slightly curved and smooth to provide a suitable guide for directing the skis to their proper location. The curved surface (17) adjacent the outer edge of the ski is curved in a generally convex manner from the outer edge of the ski to the top portion of the device. The shape of this surface serves to guide ski tips which are crossed back to their original parallel alignment in the easiest and most direct manner without employing any mechanical hinges or other similar devices. I have found that in actual use when ski tips are crossed and I attempt to return the skis to their parallel postion this curved surface (17) guides the crossed skis quickly and easily back to their desired position without the possibility of any hangup and with a smooth return to the original position with a minimum of effort. The surface (18) adjacent the inner edge of the ski although slightly curved is substantially perpendicular with respect to the upper surface of ski (10) and serves the purpose of preventing one ski from stepping on the inner edge of the other ski or from the more serious problem of the tips crossing one another. Since in normal use the skis do flutter individually with respect to each other, it is important that the inner surface (18) does not extend beyond the inside edge of ski (10). The height of this device above the upper surface of ski (10) is not particularly critical although it is most desirable that the height be about the same as the width of the ski from its inside edge to its outside edge. This height is generally about the same as the height of the tip of a giant slalom ski in its elevation above the surface of the main portion of the ski. The device is usually mounted about ten to twelve inches behind the tip of the ski.

The central portion of this device is hollow as shown at space (16) both for the purposes of providing the most streamlined effect and for providing the least amount of weight. It is most desirable to have the thickness of the solid portions of the triangular device as thin as possible, consistent with good strength for its purpose. This device is made of a resilient synthetic plastic material such as polyurethane, and the thickness of the sections are normally about one-quarter inch at their thinnest portions and slightly heavier at the corners in order to provide the necessary strength at these locations. The length of the device in the direction of the length of the ski is not particularly critical, although it is necessary to have sufficient material to provide the strength required in the use of this device. In general, the lengthwise dimension should be from about one-quarter inch to about one to one and a half inches, although larger dimensions would not cause this device to be inoperable until the dimensions became so large as to cause an intolerable amount of weight and an unsightly appearance.

Fastening plate (12) may be made of any suitable material, metal being preferred because of its inexpensiveness and ease of fabrication. Suitable plastic materials are also within the scope of this invention as would be apparent to a skilled design-engineer. In the embodiment of FIGS. 2 and 3, it will be seen that the fastening plate (12) is comprised of a single piece having two rectangular hollow portions adapted to receive the base portions (20) of the device of this invention. When those base portions are inserted into the outside of the rectangular hollow areas of fastening plate (12) and pressed inwardly, flanges (19) will be compressed and permit insertion of base portions (20) into fastening plate (12) until those flanges reach the inner ends of the hollow portions of the fastening plate. Flanges (19) are then freed to spring back into their original position and to form a holding or fastening effect. If it is necessary to accentuate this fastening effect, it may be desirable to insert a spring-like metal piece or a resilient foam material in the bottom inside surface of fastening plate (12) to urge upwardly flanges (19).

In FIG. 4 such a spring-like metal piece or a resilient foam material is shown as layer (21) positioned under base portions (20) and flanges (19) and resting on the bottom inside surface of base plate (12).

The device of this invention is preferably constructed of a resilient polyurethane having a hardness of 45–55 D on the Shore scale. Any other suitable material of construction may be employed which is tough, impact resistant, light weight, non-abrasive, and can be manufactured with a smooth surface. Because of the frequent contact of the inner edge of the ski, which is made of steel and maintained in a sharpened conditioned, it is highly preferable that the material of my device be softer than the steel in the edge of the ski and yet hard enough that whatever contact is made will cause minimal damage to my device and none to the edge of the ski. Other plastic materials can serve as a material of construction for my device if they have the necessary resiliency and other strength characteristics at low temperatures encountered in skiing. Plastic materials such as nylon, polyolefins, polycarbonates, polyacetals, and other thermoplastic materials are suitable for this purpose if they have such properties.

The device of this invention is shown in a triangular shape which is desirable for its natural superior strength as compared to a rectangular formation, in that it is able to transmit any force of shock throughout the device and to absorb it with less deformation than do other shapes.

This invention has been described with respect to its preferred embodiments and it will be understood that my invention is intended to include equivalents which would be apparent to those skilled in this particular art and that I do not intend to have my invention limited in any respect other than that shown in the appended claims.

I claim:

1. An anti-tip crossing device for skis adapted to be mounted on the front upper surface of a ski substantially perpendicular thereto, comprising a generally triangular annulus made of resilient plastic and having two upstanding sides and a base completely encircling a central open space except for a gap in the middle of said base, said base being positioned transversely across substantially the entire width of said ski, a first side of said annulus adjacent the inner edge of said ski extending substantially perpendicularly from the upper surface of the ski at its inner edge to an apex, a second side of said annulus extending from the upper surface of the ski at its outer edge to said apex in convexly arcuate shape, said annulus being detachably mounted to the upper surface of the ski by means of a base plate fixed to the upper surface of the ski and positioned transversely thereof, said base plate comprising two tubular portions aligned with each other and spaced apart from each other near the center of the ski, said base of said annulus comprising two separate prongs joined respectively to said first side and said second side and projecting toward each other, the cross-section of each prong being substantially the same size and shape as the cross-section of said tubular portions of said base plate except for a flange member at the free end of each prong which is sufficiently larger than said cross-section so as to be insertable when compressed into the tubular portion and to expand to the uncompressed state in the central space between said tubular portions to form a tight fastening of the flange member to said base plate.

2. The device of claim 1 wherein the cross sections of said prongs and of said tubular sections are rectangular.

3. The device of claim 1 wherein the base plate is a nonresilient material.

4. The device of claim 1 wherein the resilient plastic is polyurethane.

5. A ski to which is detachably mounted an anti-tip crossing device comprising a base plate fixed transversely to the front, upper surface of the ski and an upstanding generally triangular annulus made of resilient plastic and having two upstanding sides and a base completely encircling a central open space except for a gap in the middle of said base, said base being detachably mounted to said base plate comprising two aligned tubular portions spaced apart from each other near the center of the ski, said annulus having a first side extending from the upper surface of said ski at its inner edge in a substantially perpendicular direction to an apex, a second side extending from the upper surface of said ski at its outer edge in a convexly arcuate direction to said apex, and said base comprising two separate prongs projecting toward each other respectively from said first and second sides, each prong having a cross section substantially the same size and shape as the cross section of said tubular portions except that at the terminal portion of each prong is a flange sufficiently larger in cross section than that of the tubular portions so as to be insertable in the tubular portion when compressed and to expand to the uncompressed state in the central space between said tubular portions to form a tight fastening of the flange member to said base plate.

6. The ski of claim 5 wherein said cross sections of said prongs and of said tubular portions are rectangular.

7. The ski of claim 5 wherein the base plate is a non resilient material.

8. The ski of claim 5 wherein the resilient plastic is polyurethane.

9. The ski of claim 5 wherein there is included between said base plate and said ski a layer of resilient foam material as a vibration dampener.

10. The ski of claim 9 wherein there is additionally included a layer of resilient foam material between said base plate and said prongs.

* * * * *